US007032570B2

(12) United States Patent
Watanabe et al.

(10) Patent No.: US 7,032,570 B2
(45) Date of Patent: Apr. 25, 2006

(54) ELECTRONIC THROTTLE CONTROL DEVICE FOR ENGINE

(75) Inventors: Shinji Watanabe, Tokyo (JP); Tsuneo Tanabe, Hyogo (JP)

(73) Assignee: Mtisubishi Denki Kabushiki Kaisha, Tokyo (JP)

( * ) Notice: Subject to any disclaimer, the term of this patent is extended or adjusted under 35 U.S.C. 154(b) by 0 days.

(21) Appl. No.: 11/081,515

(22) Filed: Mar. 17, 2005

(65) Prior Publication Data

US 2006/0060168 A1 Mar. 23, 2006

(30) Foreign Application Priority Data

Sep. 22, 2004 (JP) ..... P2004-275552

(51) Int. Cl.
*F02D 7/00* (2006.01)

(52) U.S. Cl. ..... 123/399; 123/361

(58) Field of Classification Search ..... 123/399, 123/361, 350; 701/102, 103
See application file for complete search history.

(56) References Cited

U.S. PATENT DOCUMENTS 5,130,930 A * 7/1992 Musa ..... 701/103
6,414,607 B1 * 7/2002 Gonring et al. ..... 341/20
6,766,785 B1 * 7/2004 Ishida et al. ..... 123/399

FOREIGN PATENT DOCUMENTS

JP 2001-350594 A 12/2001
JP 2003-028001 A 1/2003

* cited by examiner

*Primary Examiner*—Mahmoud Gimie
(74) *Attorney, Agent, or Firm*—Sughrue Mion, PLLC

(57) ABSTRACT

A throttle valve control block in a microcomputer has a processing load judging means for judging a processing load status of the microcomputer, and an AD converting means for converting an analog opening degree detection signal and outputting a digital opening degree detection signal. The AD converting means has a first conversion mode in which the digital conversion is carried out with high conversion precision, and a second conversion mode in which the digital conversion is carried out with conversion precision lower than the first conversion mode. The first and second conversion modes are set to be switchable to each other, and also switched by the process load judging means.

13 Claims, 7 Drawing Sheets

ELECTRONIC THROTTLE CONTROL DEVICE FOR ENGINE

BACKGROUND OF THE INVENTION

1. Field of the Invention

The present invention relates to an electronic throttle control device for controlling an engine for a vehicle, for example, and particularly to an improvement of an electronic throttle control device for an engine with which the detection precision of a throttle opening degree can be enhanced by using an inexpensive AD converting means having relative low resolution.

2. Description of the Related Art

An electronic throttle control device for an engine electronically controls a throttle valve for adjusting an suction air amount of the engine, and is generally equipped with a throttle valve, a throttle opening degree detecting unit and a throttle valve control circuit. The throttle opening degree detecting unit generates an analog opening degree detection signal whose magnitude is proportional to the opening degree of the throttle valve. The throttle valve control circuit receives a throttle opening degree target signal and the analog opening degree detection signal, and controls the opening degree of the throttle valve so that the analog opening degree detection signal corresponds to the opening target signal.

The throttle valve control circuit digitally controls the opening degree of the throttle valve by using a microcomputer. In connection with this digital control, the analog opening degree detection signal from the throttle opening degree detecting unit is converted to a digital opening detection signal by using an AD converting means. The AD converting means is constructed by using a microcomputer, however, in order to reduce the cost of the microcomputer, an inexpensive AD converting means having low resolution is desirable.

JP-A-2003-28001 discloses a prior art which uses an AD converting means having low resolution and also can enhance the detection precision of the throttle opening degree. The AD converting means disclosed in this prior art has a level converting circuit in which plural resistors are connected to an analog input portion in series, and also has an adding means at a digital output portion. The level converting circuit generates plural analog signals different in level on the basis of the analog opening degree detection signal. The AD converting unit converts the plural analog signals to corresponding digital signals, and generates plural digital outputs. These plural digital outputs are added with one another in the adding unit.

The plural analog signals generated by the level converting circuit are called as offset-attached voltages. The plural offset-attached voltages are different from one another in analog level, and the analog levels of all the offset-attached voltages are varied in connection with variation of the analog opening degree detection signal. These plural offset-attached voltages are converted to digital outputs by the AD converting means, and added in the adding means, so that the AD converting means has higher conversion precision surpassing there solution thereof. By using the AD converting means as described above, the throttle opening degree can be detected with higher precision while using a more inexpensive AD converting means.

However, in the above prior art, it is necessary to convert each of the plural offset-attached voltages to the corresponding digital output at a predetermined sampling timing, and thus it takes a long time to carry out the AD conversion processing. In general, in the case of a vehicle, a microcomputer for controlling an engine is commonly used among plural control operations to the engine, and thus the increase of the AD conversion processing time for the electronic throttle control may be an obstacle to the other control operations of the engine. In order to avoid this disadvantage, it is necessary to use an AD converting means having a short processing time for the electronic throttle control, and thus an expensive microcomputer having a high processing speed must be adopted, so that the prior art described above cannot be actively applied and thus the cost is increased.

For example, when a microcomputer for carrying out fuel injection control for an engine and ignition control of the engine is commonly used to electronic throttle control, it is necessary detect the crank angle of the engine with high resolution in order to control the combustion state of the engine with high precision. The crank angle signal (for example, a pulse signal is generated every crank angle of 6 degrees) is input to interruptive processing of the microcomputer at high speed in proportion to the rotational speed of the engine, so that the processing load of the microcomputer is increased in proportion to the rotational speed of the engine. Therefore, in the case of a microcomputer having a low processing speed, it is concerned that reset occurs due to deficient processing time, and in order to avoid this, it is necessary to use an expensive microcomputer having a high processing speed, resulting in increase of the cost.

SUMMARY OF THE INVENTION

Therefore, an object of the invention is to provide an electronic throttle control device for an engine which has been improved to prevent an obstruction to other engine control operations while using an AD converting means having relatively low resolution.

In order to attain the above object, according to the invention, there is provided an electronic throttle control device for an engine includes a throttle valve for adjusting an suction air amount of the engine, a throttle opening degree detecting unit for detecting an opening degree of the throttle valve and generating an analog opening degree detection signal whose magnitude corresponds to the opening degree of the throttle valve, and a throttle valve control block for controlling the opening degree of the throttle valve. The throttle valve control block is constructed by common use of a microcomputer for carrying out the other control operation of the engine. The throttle valve control block includes a processing load judging means, an AD converting means and a throttle valve control means. The processing load judging means is for judging a processing load status of the microcomputer. The AD converting means is for converting an analog opening degree detecting signal and outputting the digital opening degree detection signal at an output point. The throttle valve control means is for controlling the opening degree of the throttle valve on the basis of a digital opening degree target signal to the throttle valve and the digital opening degree detection signal. The AD converting means has a first conversion mode in which the analog opening degree detection signal is converted to the digital opening degree detection signal with high conversion precision, and a second conversion mode in which the analog opening degree detection signal is converted to the digital opening degree detection signal with low conversion precision lower than the first conversion mode. The first conversion mode and the second conversion mode are switched by the load status judging means.

In the electronic throttle control device according to the invention, the AD converting means installed in the microcomputer has the first conversion mode in which the analog opening degree detection signal is converted to the digital opening degree detection signal with high conversion precision, and a second conversion mode in which the analog opening degree detection signal is converted to the digital opening detection signal with low conversion precision lower than the first conversion mode. The first and second conversion modes are switched by the processing load judging means. Therefore, the processing load of the microcomputer can be reduced, and the throttle opening degree can be controlled with high precision by an inexpensive microcomputer containing an AD converting means having relatively low resolution without increasing the processing speed of the microcomputer. As a result, the throttle opening degree control resolution required in connection with the engine driving status can be achieved, and also anxiety for occurrence of reset due to deficient processing time of the microcomputer can be eliminated, so that it is unnecessary to use an expensive microcomputer having a high processing speed and thus the cost can be reduced.

DETAILED DESCRIPTION OF THE PREFERRED EMBODIMENTS

Preferred embodiments of an electronic throttle control device for an engine according to the invention will be described hereunder with reference to the accompanying drawings.

First Embodiment

Figure 1:
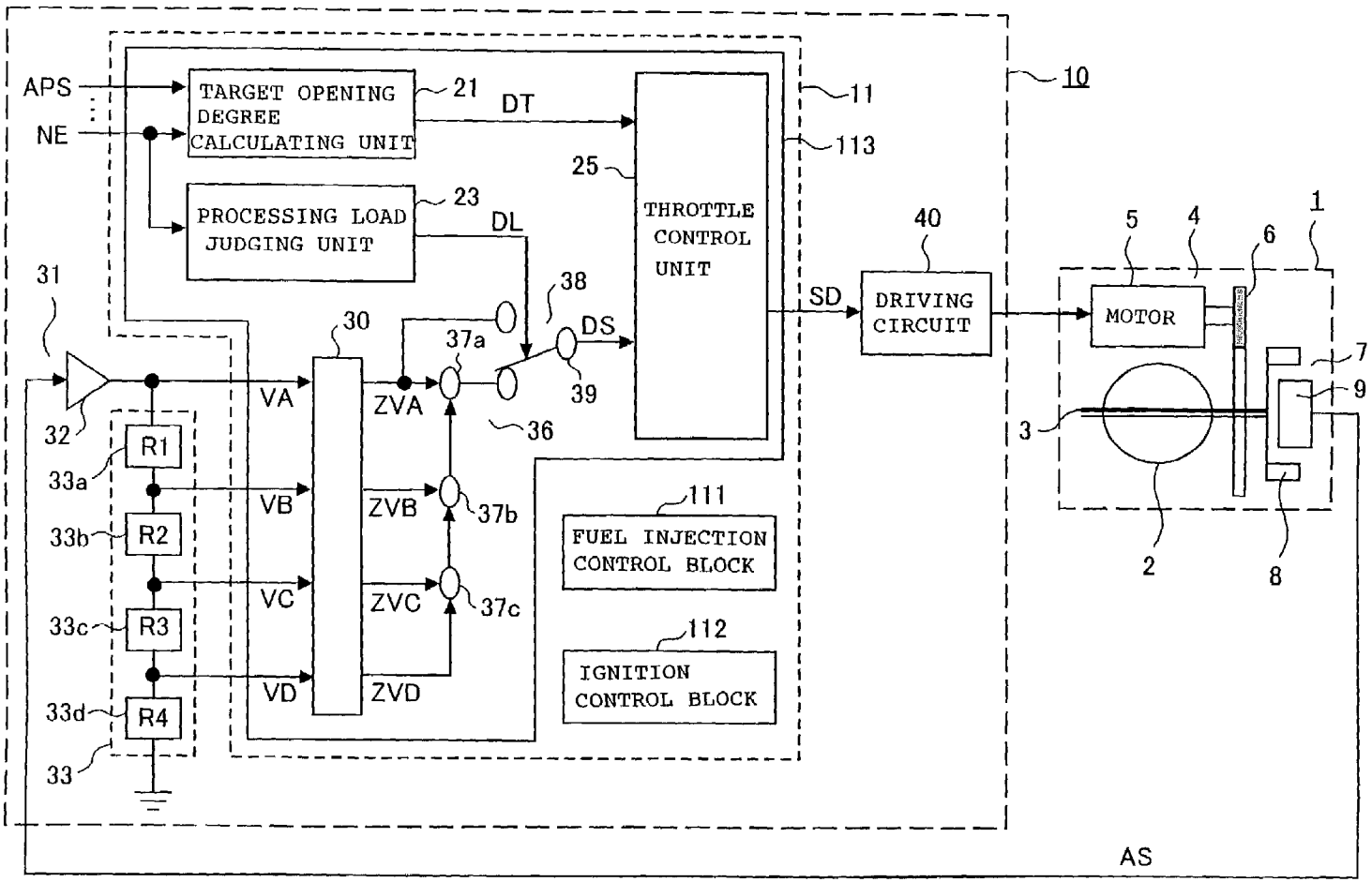
FIG. 1 is a block diagram showing a first embodiment of a throttle control device for an engine according to the invention.

FIG. 1 is a diagram showing an electronic circuit of a first embodiment of an electronic throttle control device for an engine according to the invention.

The electronic throttle control device for the engine shown in FIG. 1 is mounted in a vehicle, and contains an electronic controlled throttle device (1) and an electronic control unit (ECU) (10). The electronic controlled throttle device (1) has a throttle valve (2), a throttle valve driving mechanism (4) and a throttle opening degree detecting unit (TPS) (7). The throttle valve (2) is disposed in an air suction pipe of the engine (not shown), and adjusts the suction air amount of the engine. The throttle valve (2) is rotated around the shaft (3) thereof to adjust the opening degree of the valve, thereby adjusting the suction air amount to be supplied to the engine.

The throttle valve driving mechanism (4) has a DC motor (5) and a decelerating gear (6). The DC motor (5) is linked to the shaft (3) of the throttle valve (2) through the decelerating gear (6), and drives the throttle valve (2) through the decelerating gear (6). The throttle opening degree detecting unit (7) has a rotor (8) and a stator (9). The rotor (8) is linked to the shaft (3) of the throttle valve (2) and rotates together with the throttle valve (2). The stator (9) faces the rotor (8), and generates an analog opening degree detection signal (AS) whose magnitude is proportional to the rotational angle of the rotor (8). The magnitude of the analog opening degree detection signal (AS) is proportional to the opening degree of the throttle valve (2).

The electronic control unit (ECU) (10) has a microcomputer (11) and input/output equipments therefore. The microcomputer (11) contains a fuel injection control block (111), an ignition control block (112) and a throttle control block (113), and these control blocks (111)(112) and (113) are executed by using common CPU and memory. In other words, the invention is directed to the throttle control block (113), and the throttle control block (113) is executed together with the fuel injection control block (111) and the ignition control block (112) by commonly using same microcomputer (11).

The fuel injection control block (111) controls the amount of fuel which is injected to suction air just in front of the suction valve of the engine, and thus the injection fuel amount is controlled in connection with the suction air amount. The ignition control block (112) controls an ignition operation of an ignition plug disposed in a combustion chamber of the engine, and controls the ignition timing thereof to the optimal timing in accordance with the driving status of the engine. The fuel injection control block (111) and the ignition control block (112) are well known, and the detail description thereof is omitted.

The throttle control block (113) has a target opening degree operating means (21), a processing load judging means (23) of the microcomputer (11), a throttle control means (25) and an AD converting means (30). The target opening degree operating means (21), the processing load judging means (23), the throttle control means (25) and the AD converting means (30) are executed by using CPU and the memory of the microcomputer (11).

As a whole, the throttle control block (113) calculates, a target opening degree for the throttle valve (2) by the target opening degree calculating means (21) to generate a digital target opening degree signal (DT), converts an analog opening degree detection signal (AS) of the throttle valve (2) to a digital opening degree detection signal (DS) by the AD converting means (30), and controls the throttle valve (2) by the throttle control means (25) so that the digital opening degree detection signal (DS) is coincident with the digital target opening degree signal (DT).

The target opening degree calculating means (21) receives an analog accelerator opening degree detection signal (APS) and an analog engine rotation signal (NE), and calculates the target opening degree for the throttle valve (2) on the basis of these signals (APS) and (NE) to generate the digital target opening degree signal (DT). The magnitude of the analog accelerator opening degree detecting signal (APS) is proportional to the operating amount of the accelerator for operating the engine from the accelerator opening degree detecting unit (APS) (not shown) to the target opening degree calculating means (21). The analog engine rotation signal (NE) is generated every time a pulse period of crank pulse signals from a crank angle detecting unit (not shown) for detecting the rotational angle of the crank shaft of the engine is measured, and the magnitude of the analog engine rotation signal (NE) is proportional to the rotational number of the engine.

The processing load judging means (23) receives the engine rotation signal (NE), and outputs a digital load status signal (DL) indicating the processing load status of the microcomputer (11) on the basis of the engine rotation signal (NE). Specifically, if the rotational number of the engine is equal to or more than a first predetermined value NE1 [NE1=4000 r/m], the load status signal (DL) becomes a heavy load signal (DLH). If the rotational number of the engine is equal to or less than a second predetermined value NE2 [NE2=3500 r/m], the load status signal (DL) becomes a light load signal (DLL). The heavy load signal (DLH) indicates that the processing load of the microcomputer (11) is heavy, and the light load signal (DLL) indicates that the processing load of the microcomputer (11) is light.

The AD converting means (30) is designed to have relatively low resolution. The AD converting means (30) having the relatively low resolution is effective to reduce the price of the microcomputer (11). If the microcomputer (11) is constructed by a microcomputer having a small number of bits, the microcomputer (11) is inexpensive, and as a result the AD converting means (30) has low resolution.

The AD converting means (30) includes an analog input portion (31) and a digital output portion (36). The analog input portion (31) is added to the outside of the microcomputer (11) as an input circuit for the microcomputer (11). The digital output portion (36) is equipped in the microcomputer (11).

The analog input portion (31) has an operational amplifier (32) and a level converting circuit (33). The operational amplifier (32) is supplied with the analog opening degree detecting signal (AS) from the throttle opening degree detecting unit (7), and outputs an analog voltage (VA) based on the analog opening degree detection signal (AS) thus input. The level converting circuit (33) has plural resistors (33*a*) to (33*d*) whose number is equal to N (for example, N=4). These resistors are connected to one another in series between the output portion of the operational amplifier (32) and reference potential. The resistors (33*a*) to (33*d*) have resistance values R1, R2, R3 and R4 respectively, and on the basis of an analog voltage (VA) output from the operational amplifier (32), the resistors (33*a*) to (33*d*) generate analog voltages (VA), (VB), (VC), (VD) of N which are different in level. The analog voltage (VA) is directly output at the connection point between the operational amplifier (32) and the resistor (32*a*). The analog voltage (VB) is output at the connection point between the resistor (33*a*) and the resistor (33*b*), the analog voltage (VC) is output to the connection point between the resistor (33*b*) and the resistor (33*c*), and the analog voltage (VD) is output at the connection point between the resistor (33*c*) and the resistor (33*d*).

The analog voltages (VA), (VB), (VC) and (VD) are achieved by subjecting the analog voltage (VA) output from the operation amplifier (32) to level conversion through the resistors (33*a*) to (33*d*), and these voltages have different levels. These voltages have the relationship in level of VA>VB>VC>VD, and each level is varied in accordance with variation of the analog opening degree detection signal (AS). These analog voltages (VA), (VB), (VC), (VD) are input as analog input voltages to the AD converting means (30).

The AD converting means (30) has two conversion modes, that is, a first conversion mode (M1) and a second conversion mode (M2), and the first conversion mode (M1) and the second conversion mode (M2) are set to be switchable to each other. In the first conversion mode (M1), digital conversion having high conversion precision is executed, and in the second conversion mode (M2), digital conversion having low conversion precision lower than the first conversion mode (M1) is executed. Specifically, in the first conversion mode (M1), the analog voltage (VA), (VB), (VC), (VD) are digitally converted, and digital conversion outputs (ZVA), (ZVB), (ZVC), (ZVD) are output. In the second conversion mode (M2), only the analog voltage (VA) is digitally converted, and only the digital conversion output (ZVA) is output. In each of the first and second conversion modes (M1) and (M2), the analog input voltage is taken into the AD converting means (30) and digitally converted every predetermined sampling period, for example, every 2.5 milliseconds.

The first conversion mode (M1) and the second conversion mode (M2) are switched to each other on the basis of the load status signal (DL) from the processing load judging means (23). If the load status signal (DL) is the heavy load signal (DLH), the second conversion mode (M2) having low conversion precision is executed. On the other hand, if the load status signal (DL) is the light load signal (DLL), the first conversion mode (M1) having high conversion precision is executed.

The digital output portion 36 has adding means (37*a*), (37*b*), (37*c*) of numbers of [N−1], and a switching means (38). The adding means (37*c*) adds the digital conversion output (ZVD) of the analog voltage (VD) with the digital conversion output (ZVC) of the analog voltage (VC), and outputs an addition output (ZVC+ZVD). The adding means (37*b*) adds the digital conversion output (ZVB) of the analog voltage (VB) with the addition output (ZVC+ZVD), and outputs an addition output (ZVB+ZVC+ZVD). The adding means (37*a*) adds the digital conversion output (ZVA) of the analog voltage (VA) with the addition output (ZVB+ZVC+ZVD), and outputs the total addition output (ZVA+ZVB+ZVC+ZVD).

The switching means (38) switches a first connection state for connecting an output point (39) and the addition output of the adding means (37*a*), and a second connection state for connecting the output point (39) and the digital conversion output (ZVA) to each other. This switching means (38) is switched on the basis of the load status signal (DL) from the processing load judging means (23). Specifically, if the load status signal (DL) is the heavy load signal (DLH), the switching means (38) is set to the second connection state. On the other hand, if the load status signal (DL) is the light load signal (DLL), the switching means (38) is set to the first connection state.

As described above, the processing load judging means (23) carries out the switching operation of the conversion mode of the AD converting means (30) and the switching operation of the switching means (38). If the load status signal (DL) is the heavy load signal (DLH), the conversion mode of the AD converting means (30) is set to the second conversion mode (M2), and also the switching means (38) is set to the second connection state. Under this state, only the analog voltage (VA) is digitally converted by the second conversion mode (M2), and only the digital conversion output (ZVA) is output. The digital conversion output (ZVA) is output as a digital opening degree detection signal (DS) through the switching means (38) to the output point (39). Under this state, since a heavy load is imposed on the microcomputer (11), the AD converting means (30) carries out the converting operation in the second conversion mode (M2) having low conversion precision, and the adding means (37*a*) to (37*c*) stop the adding operations. This is effective to suppress increase of the load of the microcomputer (11) by the throttle control block (113).

If the load status signal (DL) is the light load signal (DLL), the conversion mode of the AD converting means (30) is set to the first conversion mode (M1), and also the switching means (38) is set to the first connection state. Under this state, all the analog voltages (VA), (VB), (VC), (VD) are converted to the corresponding digital conversion outputs (ZVA), (ZVB), (ZVC), (ZVD) by the first conversion mode (M1), the digital conversion outputs (ZVA), (ZVB), (ZVC), (ZVD) are added by the adding means (37*a*) to (37*c*), and the total addition output (ZVA+ZVB+ZVC+ZVD) is output as a digital opening degree detection signal (DS) to the output point (39) by the switching means (38). Under this state, since a light load is imposed on the microcomputer (11), the AD converting means (30) carries out the converting operation in the first conversion mode (M1) having high conversion precision, and the adding means (37*a*) to (37*c*) carry out the adding operations. This is effective to operate the AD converting means (30) having relatively low resolution substantially in the first conversion mode (M1) having high conversion precision and achieve a digital opening degree detection signal (DS) having high precision. Furthermore, under an idle driving state in which a light load is imposed on an engine, it is particularly required to detect the digital opening degree detection signal (DS) with high precision, and this requirement is also satisfied.

The digital target opening degree signal (DT) from the target opening degree calculating means (21) and the digital opening degree detection signal (DS) from the output point (39) are input to the throttle control means (25). The throttle control means (25) calculates a driving signal (SD) with which the digital opening degree detection signal (DS) is coincident with the digital target opening degree signal (DT), and supplies the driving signal (SD) to the driving circuit (40). The driving signal (SD) is a driving signal for subjecting the throttle valve (2) to feedback (F/B) control, and for example it is a duty signal for subjecting the DC motor (5) to PWM control. The driving circuit (40) is an output circuit connected to the outside of the microcomputer (11), and the DC motor (5) of the throttle valve driving mechanism (4) is driven by the driving circuit (40). The DC motor (5) drives the throttle valve (2) through the decelerating gear (6). The DC motor (5) drives the throttle valve (2) so that the digital opening degree detection signal (DS) is coincident with the digital target opening degree signal (DT), and the opening degree of the throttle valve (2) is adjusted to a value indicated by the digital target opening degree signal (DT).

When a low-pass filter (not shown) comprising a resistor and a capacitor is applied to the analog opening degree detection signal (AS) from the throttle opening degree detecting unit (7), the resistance values R1 to R4 of the respective resistors (33*a*) to (33*d*) must be set to large values in order to secure dynamic ranges of the analog voltages (VA), (VB), (VC), (VD).

The operational amplifier (32) separates the throttle opening degree detecting unit (7) from the impedance of the level converting circuit (33), and contributes reduction of the respective resistance values R1 to R4 and enhancement of the precision of the digital conversion value by the AD converting means (30). In general, it has been found that some displacement occurs between the analog input voltage and the digital conversion value in the AD converting means (30) if external impedance increases when the analog opening degree detection signal (AS) is converted to the plural analog voltages (VA), (VB), (VC), (VD). Accordingly, in order to avoid this phenomenon, the operational amplifier (32) is inserted as a buffer as shown in FIG. 1, and impedance conversion is carried out. Accordingly, the resistance values R1 to R4 of the resistors (33*a*) to (33*d*) can be set to small values to the extent that the AD conversion of the AD converting means (30) suffers no effect.

Next, the processing operation in the AD converting means (30) and the microcomputer (11) will be described in more detail with reference to FIGS. 2 to 7. First, the resolution of the AD converting means (30) will be described.

In general, the resolution a of the AD converting means (30) is represented by a bit number, and when the number of bits of the AD converting means (30) is represented by n (n represents natural number), the resolution of the AD converting means (30) is given according to the following equation (1) by using a reference voltage Vref of the AD converting means (30).

$$a = Vref/2^n \tag{1}$$

The resolution a given by the equation (1) indicates that a voltage smaller than this value cannot be identified.

Figure 2:
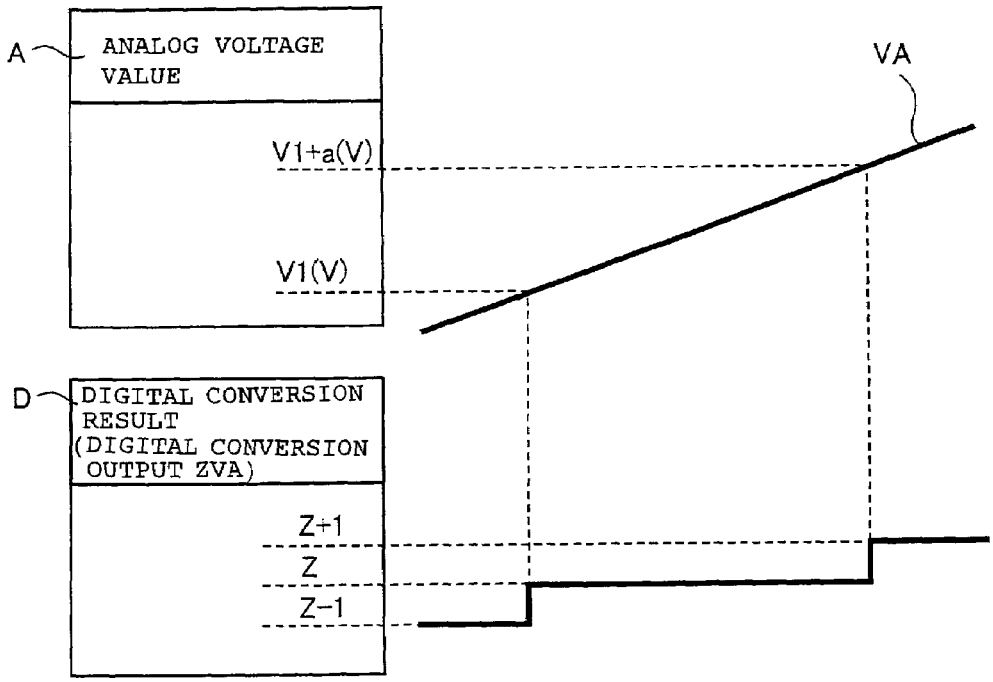
FIG. 2 is a diagram showing the relationship between an input voltage of an AD converting operation in a second conversion mode and an AD conversion result in the first embodiment.

FIG. 2 shows the relationship between voltage values V1(V), V1+a(V) to the analog voltage (VA) and the digital conversion values Z−1, Z, Z+1 of the digital conversion output (ZVA) when the analog voltage (VA) is input to the AD converting means (30). FIG. 2 corresponds to the converting operation of the AD converting means (30) in the second conversion mode (M2).

In FIG. 2, an inclined line VA represents variation of the analog voltage (VA) output from the level converting circuit (33). A block (A) at the upper portion of FIG. 2 represents analog voltage values, and specific voltage values V1, (V1+a) to the analog voltage (VA) are represented by two horizontal lines in this block (A). A block (D) at the lower portion of FIG. 2 represents a digital conversion result, and specific digital conversion values (Z−1), Z, (Z+1) of the digital conversion output (ZVA) are represented by three horizontal lines in this block (D).

When the analog voltage (VA) is smaller than the voltage value V1(V), the digital conversion output (ZVA) is equal to the digital conversion value (Z−1). When the analog voltage (VA) increases and reaches the voltage value V1(V), the digital conversion output (ZVA) is equal to the digital conversion value Z. When the analog voltage (VA) further increases and reaches the voltage value (V1+a), the digital conversion output (ZVA) thereof is equal to the digital conversion value (Z+1). In other words, when an analog voltage V in the range of V1 V<(V1+a) is subjected to AD conversion in the conversion operation based on the second conversion mode (M2) shown in FIG. 2, the digital conversion value thereof is equal to Z (fixed value).

Figure 3:
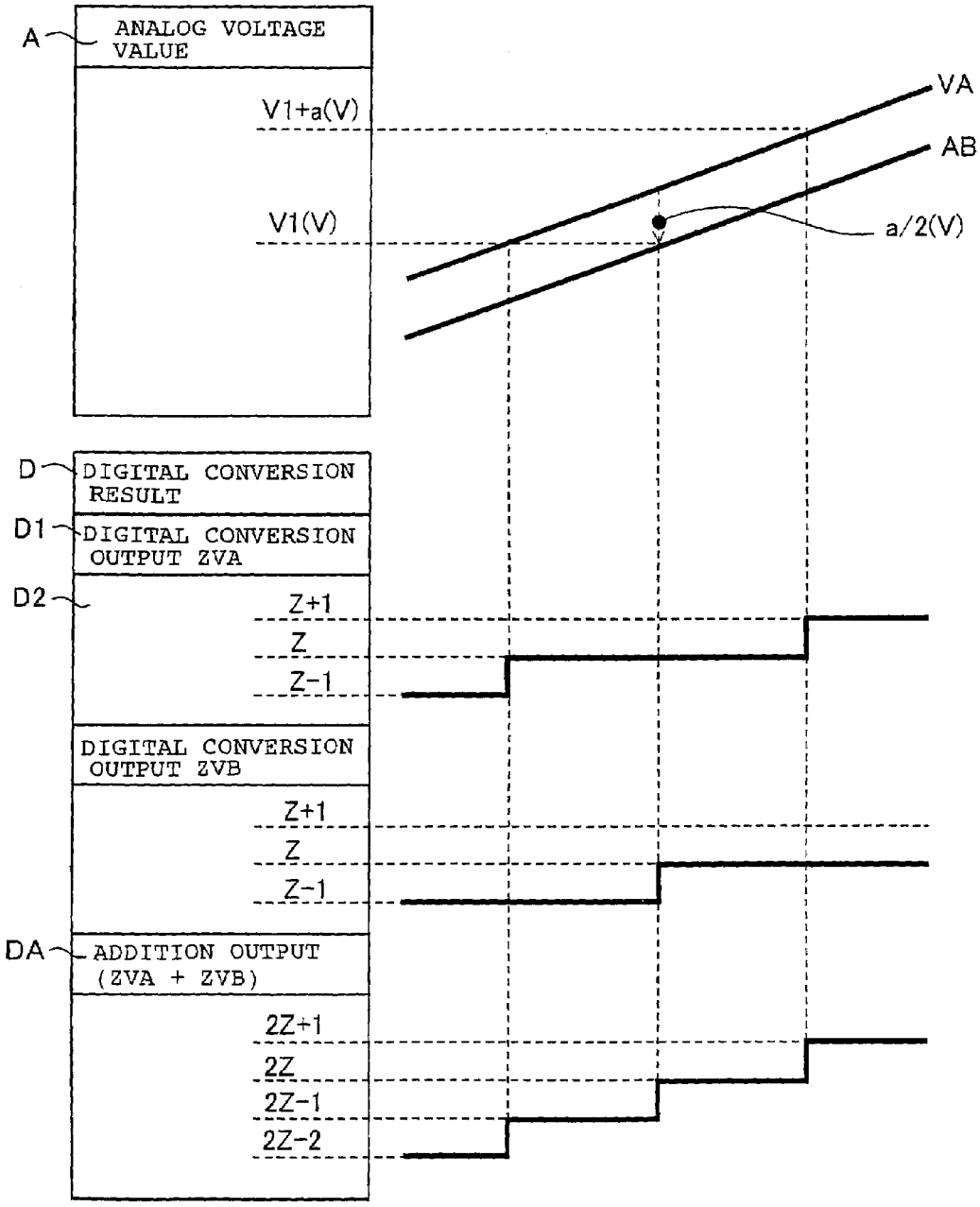
FIG. 3 is a diagram showing an AD conversion operation having higher precision of (n+1) bits.

FIG. 3 shows a converting operation when two analog voltages (VA) and (VB) are input to the AD converting means (30) and these analog voltages VA and VB are digitally converted. The converting operation shown in FIG. 3 corresponds to the first conversion mode (M2) when the level converting circuit (33) outputs the two analog voltages (VA) and (VB). That is, it corresponds to the first conversion mode (M2) in the case of N=2. In this case, the level converting circuit (33) has the two resistors (33*a*) and (33*b*), and the resistors (33*c*) and (33*d*) are omitted. The adding means (37*b*) and (37*c*) are omitted, and the adding means (37*a*) outputs the addition output (ZVA+ZVB).

In FIG. 3, two inclined parallel lines VA and VB represent variations of the analog voltages (VA) and (VB) output from the level converting circuit (33). A block (A) at the upper portion of FIG. 3 show analog voltage values, and specific voltage values V1, (V1+a) to the analog voltages (VA) and (VB) are represented by two horizontal lines in this block (A). A block (D) at the lower portion of FIG. 3 represents a digital conversion result, and three blocks (D1), (D2) and (DA) are represented in the block (D).

In the block (D1), specific digital conversion values (Z−1), Z, (Z+1) of the digital conversion output (ZVA) are represented by three horizontal lines. In the block (D2), the specific digital conversion values (Z−1), Z, (Z+1) of the digital conversion output (ZVB) are represented by three horizontal lines. The block (DA) represents the addition output (ZVA+ ZVB) of the digital conversion outputs (ZVA) and (ZVB), and in this block (DA), four digital conversion values (2Z−2), (2Z−1), 2Z, (2Z+1) are represented by horizontal lines.

In the converting operation shown in FIG. 3, the analog voltages (VA) and (VB) increase linearly in parallel to each other with increase of the analog opening degree detection signal (AS). An offset voltage (a/2) exists between the analog voltages (VA) and (VB). That is, the analog voltage (VB) is lower in level than the analog voltage (VA) by only the offset voltage Vo [Vo=(−a/2)] at all times. As described above, the analog voltages (VA) and (VB) have the offset voltage Vo therebetween, and thus these voltages (VA), (VB) are also called as offset voltage attached voltages. The digital conversion results of these analog voltages (VA) and (VB) by the AD converting means (30) are shown in the blocks (D1), (D2) and (DA) of FIG. 3.

The digital conversion output (ZVA) of the analog voltage (VA) is shown in the block (D1). When the analog voltage (VA) is smaller than the voltage value V1(V), the digital conversion output (ZVA) is equal to the digital conversion value (Z−1) as shown in the block (D1). When the analog voltage (VA) increases and reaches the voltage value V1(V), the digital conversion output (ZVA) is equal to the digital conversion value Z, and when the analog voltage (VA) further increases and reaches the voltage value (V1+a), the digital conversion output (ZVA) is equal to the digital conversion value (Z+1).

Furthermore, the digital conversion output (ZVB) of the analog voltage (VB) is shown in the block (D2). When the analog voltage (VB) is smaller than the voltage value V1(V), the digital conversion output (ZVB) thereof is equal to the digital conversion value (z−1) as shown in the block (D2). When the analog voltage (VB) increases and reaches the voltage value V1(V), the digital conversion output (ZVB) is equal to the digital conversion value Z.

The addition output (ZVA+ZVB) of the digital conversion outputs (ZVA) and (ZVB) is shown in the block (DA). The addition output (ZVA+ZVB) is equal to the digital conversion value (2Z−2) when the analog voltage (VA) is smaller than the voltage value V1(V), and it increases to the digital conversion value (2Z−1) when the analog voltage (VA) reaches the voltage value V1(V). When the analog voltage (VA) exceeds the voltage value V1(V) and the analog voltage (VB) is smaller than the voltage value V1(V), the addition output (ZVA+ZVB) keeps the digital conversion value (2Z−1). However, when the analog voltage (VB) reaches the voltage value V1(V), the addition output (ZVA+ ZVB) increases to the digital conversion value 2Z. Furthermore, when the analog voltage (VA) reaches the voltage value (V1+a), the addition output (ZVA+ZVB) further increases to the digital conversion value (2Z+1).

The analog voltage V in the range of V1 V<(V1+a) reaches just the intermediate value between V1(V) and (V1+a) (V) at the time point when the analog voltage (VB) reaches the voltage value V1(V). At this time point, the analog voltage (VB) reaches the voltage value V1(V), so that the addition output (ZVA+ZVB) increases by one step. As a result, in the converting operation of FIG. 3, the same digital conversion output as achieved in a case where the AD converting means having resolution of a/2 [(n+1) bits] is used can be achieved by using the AD converting means (30) having resolution a (n bits).

As described above, the addition digital conversion value (ZVA+ZVB) having resolution a/2 [(n+1) bits] (high precision) can be achieved by digitally converting the analog voltage (VA), digitally converting the voltage (VB) (VB=VA−a/2) achieved by adding the analog voltage (VA) with only an offset (−a/2) (V) and then adding both the digital conversion values (ZVA) and (ZVB) thus achieved as shown in FIG. 3.

That is, the offset-attached voltage (VB) is generated from the analog voltage (VA) by using the level converting circuit (33), each of the analog voltages (VA) and (VB) is subjected to AD conversion with the resolution a of n bits and the addition value of the respective conversion results of the analog voltages (VA) and (VB) is used for the control, thereby achieving the same control resolution as achieved in a case where the conversion value based on the AD converter having the resolution a/2 [(n+1) bits] is used.

A case where the number N of analog voltages output from the level converting circuit (33) is further increased will be described. In this case, the level converting circuit (33) having resistors of numbers N($N=2^b$) is used for the analog opening degree detection signal (AS) from the throttle opening degree detecting unit (7), the analog opening degree detecting signal (AS) is converted to analog voltages of numbers $2^b$ by offsetting the analog opening degree detecting signal (AS) every $-a/2^b$(V) (b represents a natural number), the analog voltages of numbers $2^b$ thus achieved are input to the AD converting means (30) having the resolution a (V) (n bits), the respective analog voltages are subjected to AD conversion and the digital conversion outputs of the analog voltages are added to one another, whereby the digital opening degree detection voltage (DS) can be detected with the same precision as a case where an AD converting means of (n+b) bits is used.

Therefore, the offset attached voltages (VA), (VB), (VC), (VD), etc. are generated from the analog voltage (VA) like the analog voltage VB ($VB=VA-a/2^b$(V)), the analog voltage VC ($VC=VB-a/2^b$(V)), the analog voltage VD ($VD=VC-a/2^b$(V)), etc. by using the level converting circuit (33) (offset unit) in the electronic control unit (10).

Subsequently, the respective offset attached voltages (VA), (VB), (VC), (VD), etc. are AD-converted to digital conversion outputs by using the AD converting means (30) having resolution of n bits, all these digital conversion outputs thus achieved are added to one another by using the adding means (37*a*), (37*b*), (37*c*), etc. in the microcomputer (11) to achieve an addition output, and the DC motor (5) is driven through the throttle control means (25) by using the addition output as the digital opening degree detection signal (DS) to control the opening degree position of the throttle valve (2), whereby the same control resolution as achieved when the control is carried out by using an AD converting means of (n+b) bits.

For example, it has been found that in order to control the idle rotational speed (several hundreds r/m) of the engine with sufficiently high precision, the analog opening degree detection signal (AS) from the throttle opening degree detecting unit (7) may be subjected to AD conversion by using an AD converting means having resolution of 12 bits or more.

In the first embodiment shown in FIG. 1, the four offset attached voltages (VA), (VB), (VC), (VD) are generated by using the level converting unit (33) (offset unit) having the four resistors (33*a*) to (33*d*), and thus the throttle opening around the idle rotational speed can be detected substantially with precision of 12 bits by using an AD converting means (30) of 10 bits.

Figure 4:
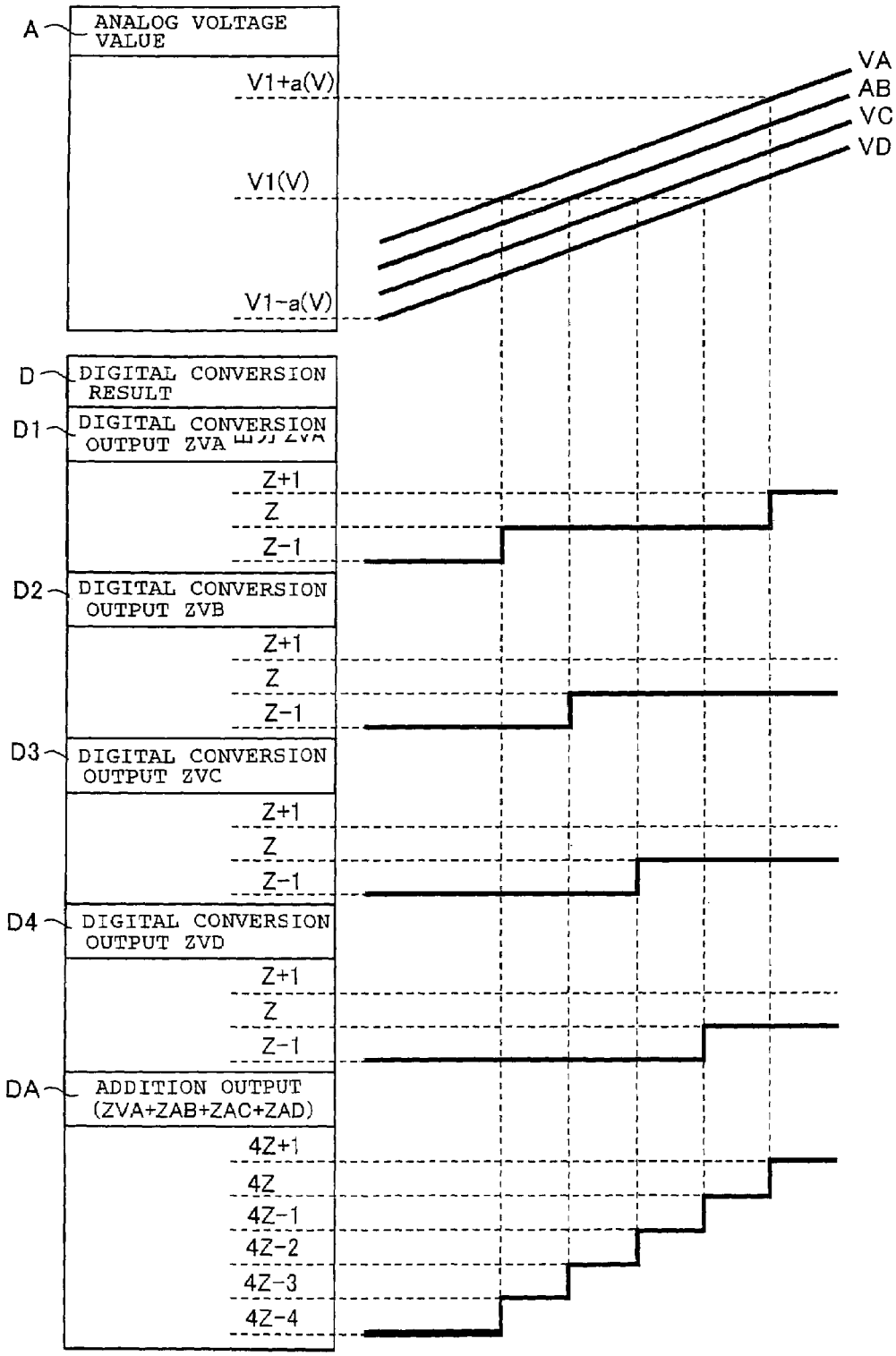
FIG. 4 is a diagram showing the relationship between an input voltage of the AD converting operation in a first conversion mode and an AD conversion result in the first embodiment.

FIG. 4 is a diagram showing the processing operation based on the AD converting means (30) of 10 bits and the adding means (37*a*) to (37*c*). In this case, the four offset attached voltages (analog voltages) (VA) to (VD) are subjected to AD conversion, and the respective digital conversion outputs (ZVA), (ZVB), (ZVC) and (ZVD) thereof are added to one another, whereby conversion precision of 12 (=10+2) bits is implemented. This operation corresponds to the first conversion mode (M1).

In FIG. 4, four inclined parallel lines VA, VB, VC, VD represent variations of the analog voltages (VA), (VB), (VC), (VD) output from the level converting circuit (33). A block (A) at the upper portion of FIG. 4 shows analog voltage values. In this block (A), specific voltage values (V1−a)(V), V1(V) and (V1+a)(V) to the analog voltages (VA), (VB), (VC), (VD) are represented by three horizontal lines. A block (D) at the lower portion of FIG. 4 shows a digital conversion result. Five blocks (D1), (D2), (D3), (D4), (DA) are shown in this block (D).

In the block (D1), specific digital conversion values (Z−1), Z, (Z+1) of the digital conversion output (ZVA) are represented by three horizontal lines. In the blocks (D2), (D3), (D4), specific digital conversion values (z−1), Z, (Z+1) of each of the digital conversion outputs (ZVB), (ZVC), (ZVD) are represented by three horizontal lines. The block (DA) shows the addition output (ZVA+ZVB+ZVC+ZVD) of the digital conversion outputs (ZVA), (ZVB), (ZVC), (ZVD) in the converting operation shown in FIG. 4. In the block (DA), six digital conversion values (4Z−4), (4Z−3), (4Z−2), (4Z−1), 4Z, (4Z+1) are represented by horizontal lines.

In the converting operation shown in FIG. 4, the analog voltages (VA), (VB), (VC), (VD) increase linearly in parallel to one another with increase of the analog opening degree detection signal (AS). An offset voltage Vo of (−a/2) exists between the analog voltages (VA) and (VB), between the analog voltages (VB) and (VC) and between the analog voltages (VC) and (VD). The conversion results achieved when the analog voltages (VA), (VB), (VC), (VD) each having an offset voltage as described above are digitally converted by using the AD converting means (30) of 10 bits are shown in the blocks (D1), (D2), (D3), (D4) and (DA) of FIG. 4.

The digital conversion outputs (ZVA), (ZVB), (ZVC), (ZVD) are shown in the blocks (D1), (D2), (D3) and (D4), respectively. The digital conversion output (ZVA) shown in the block (D1) is equal to the digital conversion value (Z−1) when the analog voltage (VA) is smaller than the voltage value V1(V). When the analog voltage (VA) increases and reaches the voltage value V1(V), the digital conversion output (ZVA) is equal to the digital conversion value Z. When the analog voltage (VA) further increases and reaches the voltage value (V1+a), the digital conversion output (ZVA) is equal to the digital conversion value (Z+1). The digital conversion outputs (DVB), (DVC), (DVD) vary with respect to the analog voltages (VB), (VC), (VD) in the same manner as described above.

The addition output (ZVA+ZVB+ZVC+ZVD) of the digital conversion outputs (ZVA), (ZVB), (ZVC), (ZVD) is shown in the block (DA). When the analog voltage (VA) is smaller than the voltage value V1(V), the addition output (ZVA+ZVB+ZVC+ZVD) is equal to the digital conversion value (4Z−4), and when the analog voltage (VA) reaches the voltage value V1(V), the addition output (ZVA+ZVB+ZVC+ZVD) increases to the digital conversion value ((4Z−3)). When the analog voltage (VA) exceeds the voltage value V1(V) and the analog voltage (VB) is smaller than the voltage value V1(V), the addition output (ZVA+ZVB+ZVC+ZVD) keeps the digital conversion value (4Z−3). However, when the analog voltage (VB) reaches the voltage value V1(V), the addition output (ZVA+ZVB+ZVC+ZVD) increases to the digital conversion value (4Z−2). Furthermore, when the analog voltage (VC) reaches the voltage value V1(V), the addition output (ZVA+ZVB+ZVC+ZVD) increases to the digital conversion value (4Z−1), when the voltage (VD) reaches the voltage value V1(V), the addition output (ZVA+ZVB+ZVC+ZVD) increases to the digital conversion value 4z, and when the analog voltage (VA) reaches the voltage value (V1+a), the addition output (ZVA+ZVB+ZVC+ZVD) increases to the digital conversion value (4Z+1).

At the time point when the analog voltage (VB) reaches the voltage value V1(V), the analog voltage V in the range of V1 V<(V1+a) reaches just ¼ value between V1(V) and (V1+a)(V), and at this time point, the addition output (ZVA+ZVB+ZVC+ZVD) increases by one step. Likewise, at the time point when the analog voltage (VC) reaches the voltage value V1(V), the analog voltage V in the range of V1 V<(V1+a) reaches just ¾ value between V1(V) and (V1+a)(V), and at this time point, the addition output (ZVA+ZVB+ZVC+ZVD) further increases by one step. Furthermore, at the time point when the analog voltage (VD) reaches the voltage value V1(V), the analog voltage V in the range of V1 V<(V1+a) reaches just ¾ value between V1(V) and (V1+a)(V), and at this time point, the addition output (ZVA+ZVB+ZVC+ZVD) further increases by one step. As a result, in the converting operation of FIG. 4, the same digital conversion output when an AD converting means having resolution of a/4 [(n+2) bits] is used can be achieved by using an AD converting means (30) having resolution a (n bits), and the AD converting means (30) of 10 bits can be operated substantially with the same conversion precision as the AD converting means of 12 bits.

If the reference voltage Vref of the AD converting means (30) of 10 bits is equal to 5(V), the resolution a of the AD converting means (30) is given from the above equation (1) by using the following equation (2).

$$a=5/2^{10}\cong 4.8[\text{mV}] \tag{2}$$

Accordingly, in order to carry out the detecting operation with substantially 12-bit resolution, the natural number b described above is set to 2 (=12−10), and the offset Vo between the analog voltages (VA) and (VB), between the analog voltages (VB) and (VC) and between the analog voltages (VC) and (VD) is set by the following equation (3).

$$Vo=a/2^2=a/4\cong 1.2[\text{mV}] \quad (3)$$

Accordingly, the resistors (33*a*) to (33*d*) (see FIG. 1) generates the offset attached voltages (VB) to (VD) [VA=AS, VB≅VA−1.2 (mV), VC≅VB−1.2 (mV), VD≅VC−1.2 (mV)] on the basis of the analog voltage (VA) from the operational amplifier (31) as shown in FIG. 4.

Furthermore, the AD converting means (30) of 10 bits subjects the respective offset attached voltages (VA) to (VD) to AD conversion, and the adding means (37*a*) to (37*c*) add the respective digital conversion outputs (ZVA) to (ZVD) and outputs the addition result as a digital opening degree detection signal (DS) whose resolution is higher by only two bits.

However, the level converting circuit (33) (offset unit) shown in FIG. 1 divides the analog voltage (VA) with the resistors (33*a*) to (33*d*) to generate the offset attached voltages (VB), (VC), (VD). Therefore, for example, if the analog voltage (VA) is varied, the offset attached voltage (VB) is also varied, so that the offset attached voltage (VB) is not necessarily surely coincident with the voltage value [VA−1.2(mV)].

However, if the throttle valve (2) is required to be controlled with high precision under only an idling operation state of the engine, the resistance values R1 to R4 of the respective resistors (33*a*) to (33*d*) may be set so that the offset attached voltages (VB) to (VD) are represented by the following equation (4) in the neighborhood of the voltage value of the analog opening degree detection signal (AS) from the throttle opening degree detecting unit (7) under the idling operation.

$$VB\cong VA-1.2\ (\text{mV})$$

$$VC\cong VB-1.2\ (\text{mV})$$

$$VD\cong VC-1.2\ (\text{mV}) \quad (4)$$

For example, when the voltage value of the analog opening degree detection signal (AS) detected under the idling operation is equal to about 0.7(V), the resistance values R1 to R4 are set by the following equation (5).

$$R1=R2=R3=18(\Omega)\ R4=10(\text{K}\Omega) \quad (5)$$

Next, the switching operation of the conversion mode of the AD converting means (30) based on the load status signal (DL) from the processing load judging means (23), the adding operation of the adding means (37*a*) to (37*c*) and the switching operation of the switching means (38) will be described with reference to the flowchart of FIG. 5 and the timing chart of FIG. 6 and FIG. 7.

Figure 5:
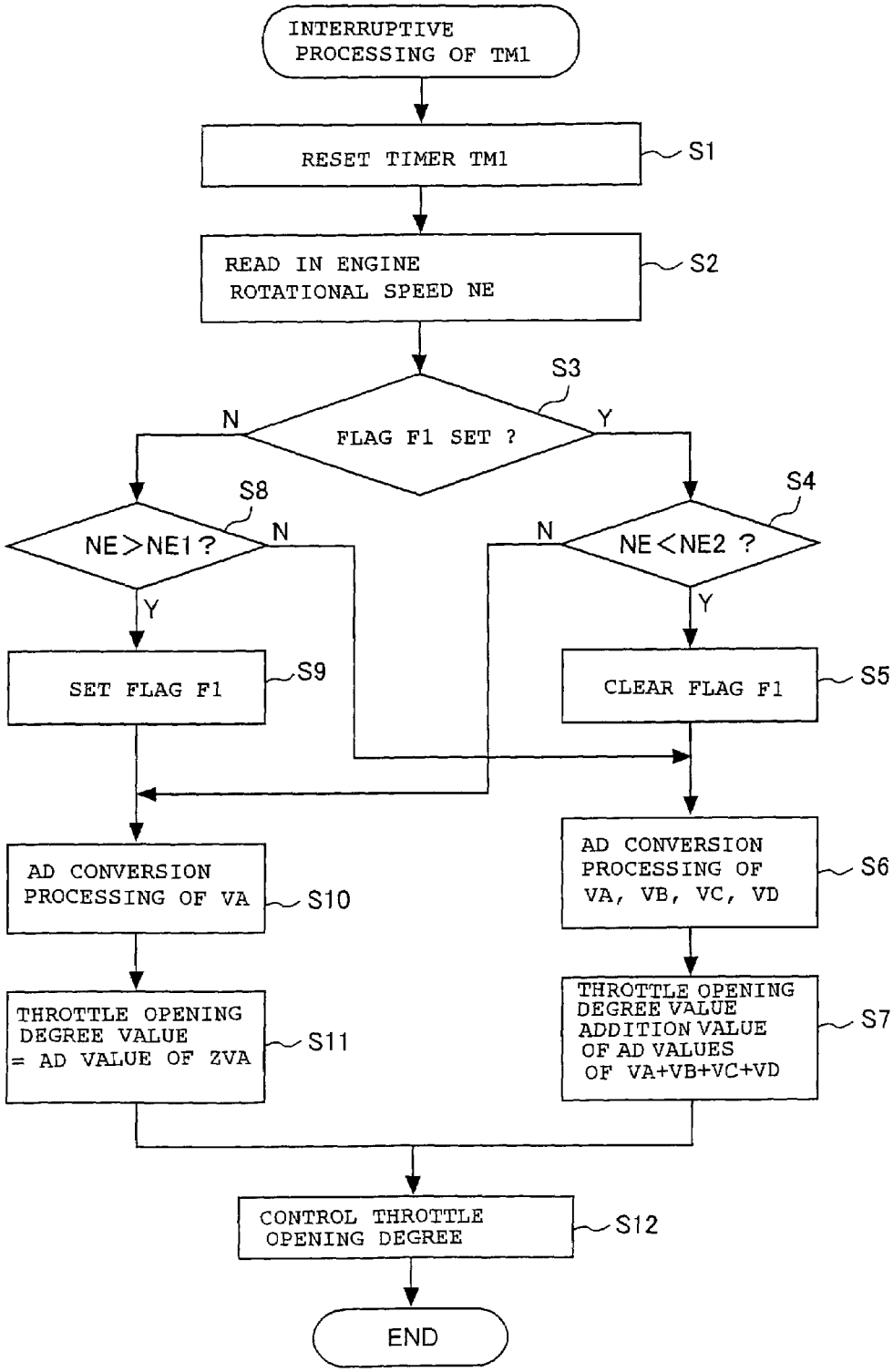
FIG. 5 is a flowchart showing the control processing in the first embodiment.

FIG. 5 is a flowchart showing the throttle control block (113), and particularly shows an AD conversion processing flow when the throttle opening degree is detected. The flowchart of FIG. 5 is executed during interruptive processing of a timer TM1 which occurs every predetermined period t1. The interruptive processing using this timer TM1 is well known as disclosed in Japanese Patent No. 3093467.

Figure 6:
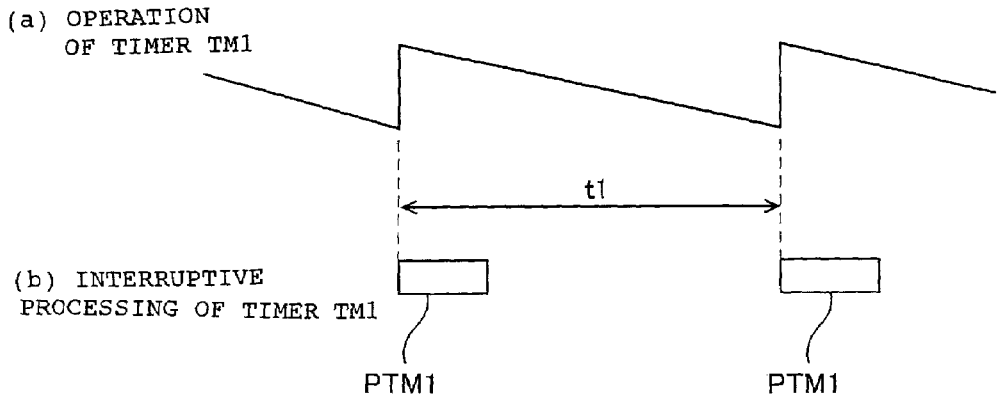
FIG. 6 is a time chart showing the AD converting operation when the engine is rotated at low speed in the first embodiment.

FIG. 6 shows the interruptive processing of the timer TM1 when the load status signal (DL) is a heavy load signal (DLH). In FIG. 6, (a) shows an operating waveform of the timer TM1, and (b) shows the interruptive processing PTM1 of the timer TM1 in connection with the operation of the timer TM1 of (a). FIG. 7 shows the interruptive processing of the timer TM1 when the load status signal (DL) is a light load signal (DLL). In FIG. 7, (a) shows an operating waveform of the timer TM1, and (b) shows the interruptive processing PTM2 of the timer TM1 in connection with the operation of the timer TM1 of (a).

Figure 7:
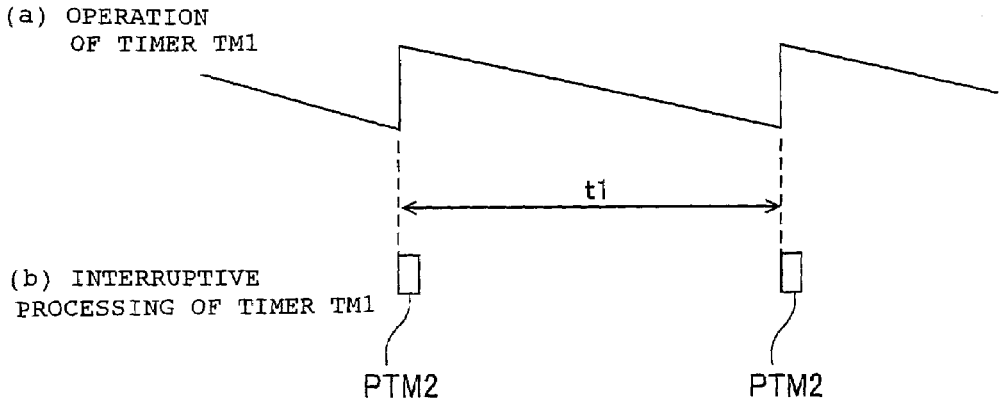
FIG. 7 is a time chart showing the AD converting operation when the engine is rotated at high speed in the first embodiment.

Comparing FIGS. 6 and 7, the interruptive processing PTM1 of the timer TM1 when the load status signal (DL) shown in FIG. 6 is the light load signal is longer in processing time than the interruptive processing PTM2 of the timer TM1 when the load status signal (DL) shown in FIG. 7 is the heavy load signal. In the interruptive processing PTM1, plural analog voltages (VA) to (VD) of numbers N are converted to digital conversion outputs (ZVA) to (ZVD) respectively, and the addition processing is also carried out by the adding means (37*a*) to (37*c*), so that the processing time of the interruptive processing PTM1 is longer than the interruptive processing PTM2.

Furthermore, in the interruptive processing of the timer TM1 of FIG. 5, a set time t1 (for example, 2.5 ms) of the timer TM1 is reset in step (S1), and an engine rotational speed signal (NE) detected through a crank angle pulse period measurement is read in from a crank angle sensor (not shown) in step (S2).

In step (S3), it is checked whether a processing load judging flag F1 in the previous AD conversion processing is set or not. The processing load judging flag F1 indicates a judgment result of the processing load judging means (23). If the processing load judging means (23) outputs a heavy load signal (DLH) in the previous AD conversion processing, the processing load judging flag F1 has been set. If the processing load judging flag F1 is set, the check result of step (S3) is YES, and thus the processing goes to step (S4). On the other hand, if the processing load judging flag F1 is not set, the check result of the step (S3) is NO, and thus the processing goes to step (S8).

When the processing load judging flag F1 is set, it is judged in step S4 whether the engine rotation signal (NE) is equal to a second predetermined value NE2 (for example, the engine rotational number is equal to 3500 r/m) or less in the present AD conversion processing. If the engine rotation signal (NE) satisfies NE NE2, the judgment result of step (S4) is NO, and the processing goes to step (S10). In step (S10), the AD converting means (30) is made to carry out the converting operation based on the second conversion mode (M2). Furthermore, if the engine rotation signal (NE) satisfies NE<NE2, the judgment result of step (S4) is YES, the load status signal (DL) is set to the light load signal (DLL), the processing load judging flag F1 is cleared in step (S5), and the processing goes to step (S6).

In step (S6), the analog voltages (VA), (VB), (VC), (VD) are taken from the level converting circuit (33) into the AD converting means (30) of 10 bits, and successively digitally converted to generate the digital conversion outputs (ZVA), (ZVB), (ZVC), (ZVD).

In the next step (S7), the digital conversion outputs (ZVA), (ZVB), (ZVC), (ZVD) are added by the adding means (37*a*) to (37*c*), and the addition output (ZVA+ZVB+ZVC+ZVD) thus calculated is output as the digital opening detection signal (DS) through the switching means (38) to the output point (39). The digital opening degree detection signal (DS) output in step (S7) has resolution of 12 bits.

In the next step (S12), the digital opening degree detection signal having the resolution of 12 bits and the digital target opening degree signal (DT) from the target opening degree calculating means (21) are inputted to the throttle control means (25), and the throttle control means (25) supplies the driving signal (SD) to the driving circuit (40) so that the throttle opening degree is coincident with the value indicated by the digital target opening degree signal (DT). The driving signal (SD) is a control DUTY signal calculated through a feedback control operation (for example, PID control operation), and the driving circuit 40 controls the opening degree of the throttle valve (2) by outputting the driving signal to the DC motor (5).

Accordingly, the same throttle opening degree control resolution as achieved when the control is carried out by using the conversion value based on the AD converting means of 12 bits can be achieved, and high-precision throttle opening degree control resolution required under the idling operation of the engine is secured. Furthermore, the digital opening degree detection signal (DS) which has substantially the resolution of 12 bits increases the processing time of the microcomputer (11) as shown in FIG. 6. However, the first conversion mode (M1) having high conversion precision which has substantially the resolution of 12 bits is executed when the load status signal (DL) is the light load signal (DLL), and thus there occurs no such a situation that the processing time of the microcomputer (11) is deficient.

If the load status judging flag F1 is cleared in the previous AD conversion processing, it is judged in step (S8) whether the engine rotation signal (NE) in the present AD conversion processing is equal to a first predetermined value NE1 (for example, the engine rotational number is equal to 4000 r/m) or more. If the engine rotational speed signal NE satisfies NE NE1, the judgment result of the step (S8) is NO, and the AD converting means (30) is made to carry out the processing goes to step S6 to carry out the processing of the first conversion mode having high conversion precision. If the engine rotation signal (NE) satisfies NE>NE1, the judgment result of the step (S8) is YES, and the processing goes to step (S9) to set the processing load judging flag F1.

In step (S10), only the analog voltage (VA) from the throttle opening degree detecting unit (7) is subjected to the AD conversion processing by the AD converting means (30) having the resolution of 10 bits. The interruptive processing PTM2 at this time has a short processing time as shown in the timing chart of FIG. 7. In step S11, only the digital conversion output (ZVA) having the resolution of 10 bits is output as the digital opening degree detection signal (DS).

In this case, in step (S12), the digital opening degree detection signal (DS) having the resolution of 10 bits and the digital target opening degree signal (DT) are input to the throttle control means (25), and the driving signal (DS) is supplied to the driving circuit (40) by the throttle control means (25). The driving circuit (40) generates a control DUTY signal calculated through a feedback control operation (for example, PID control operation) on the basis of the driving signal (DS) so that the throttle opening degree of the throttle valve (2) is coincident with the target opening degree value, and drives the DC motor (5).

Accordingly, the AD conversion processing time of the offset attached voltages (VB) to (VD) can be eliminated. Therefore, it can be avoided that reset occurs due to a deficient processing time of the microcomputer (11) under a high rotational-speed driving state of the engine, and also the control resolution of the throttle opening degree can be kept to the resolution corresponding to the driving state of the engine.

In the flowchart of FIG. 5, an intermediate zone is set between a first predetermined value NE1 (4000 r/m) of the engine rotational number and a second predetermined value NE2 (3500 r/m) of the engine rotational number. If it is judged that the engine rotational number in the present AD conversion processing is located in the intermediate zone when the processing load judging flag F1 is set in the previous AD converting operation, the judgment result of the step (S4) is NO, and the second conversion mode (M2) under a heavy load is executed in the steps (S10), (S11). If it is judged that the engine rotational number in the present AD conversion processing is located in the intermediate zone when the processing load judging flag F1 is not set in the previous AD converting operation, the judgment result of the step (S8) is NO, and the first conversion mode (M1) under a light load is executed in the steps (S6) and (S7).

In the first embodiment, the processing load judging means (23) judges the processing load status of the microcomputer (11) on the basis of the engine rotation signal (NE). However, the same effect can be achieved by judging the processing load status of the microcomputer (11) with plural engine control information (for example, engine torque information, accelerator opening degree information, a target throttle opening degree value, etc.).

Second Embodiment

Figure 8:
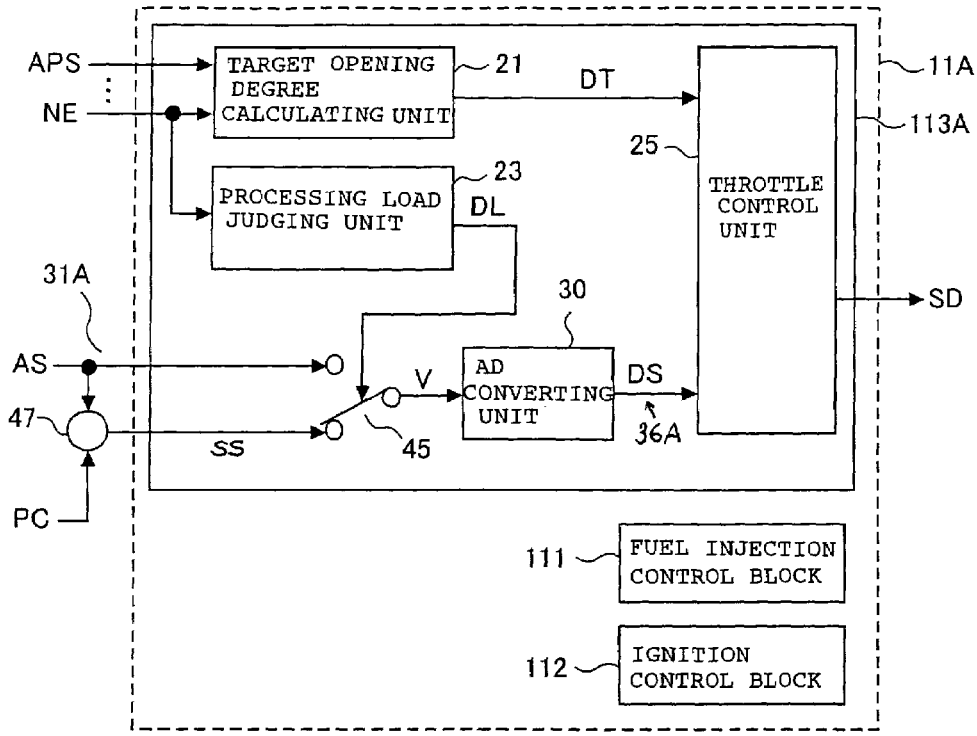
FIG. 8 is a block diagram showing a microcomputer used in a second embodiment of the throttle control device for the engine according to the invention.
Figure 9:
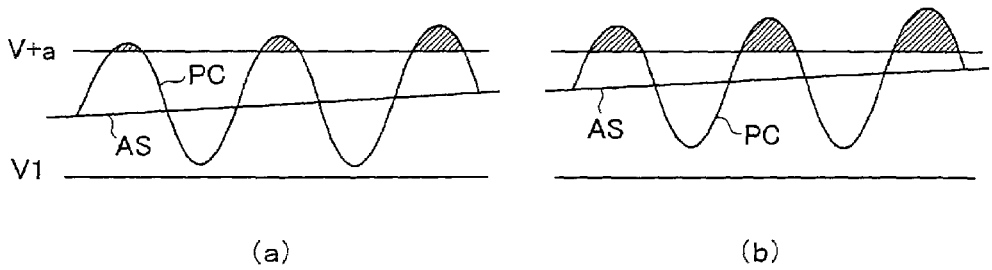
FIGS. 9(*a*) and 9(*b*) are waveform diagrams showing the superposition signal in the second embodiment.

FIG. 8 is a block diagram showing a microcomputer (113A) used in an second embodiment of the throttle control device for the engine according to the invention, and FIGS. 9(*a*) and 9(*b*) show waveforms of the analog input voltage V.

In the second embodiment, the analog input circuit (31) and the digital output circuit (36) to the AD conversion means (30) are modified. The modified analog input circuit (31A) is modified so as to have a switching means (45) and a synthesizer (47), and the modified digital output circuit (36A) is modified so as to merely supply one digital output of the AD converting means (30) as the digital opening degree detection signal (DS) to the throttle control means (25). The other parts are the same as the first embodiment.

The switching means (45) is equipped in the microcomputer (11A). The analog opening detection signal (AS) is supplied from the analog opening degree detecting unit (7) to a first input of the switching means (45). A superposition signal (SS) from the synthesizer (47) is supplied to a second input of the switching means (45). The switching means (45) switches the second input (that is, a first connection state in which the superposition signal (SS) from the synthesizer (47) is output) and the first input (that is, a second connection state in which the analog opening detection signal (AS) is output) to each other. The switching means (45) merely supplies the output thereof as one analog input voltage V to the AD converting means (30). The switching means (45) is switched on the basis of the load status signal (DL) of the processing load judging means (23). The synthesizer (47) is supplied with the analog opening degree detection signal (AS) and a period variation signal (PS) whose magnitude is periodically varied at a predetermined frequency. The output of the synthesizer (47) becomes the superposition signal (SS) achieved by analogically adding the analog opening degree detection signal (AS) and a period varying signal (PS).

If the load status signal (DL) of the processing load judging means (23) is the heavy load signal (DLH), the switching means (45) selects the second connection state, the analog opening degree detection signal (AS) is supplied to the AD converting means (30), and the digital conversion signal thereof is supplied as the digital opening degree detection signal (DS) to the throttle control means (25). Under this state, the AD converting means (30) operates in substantially the same mode as the second conversion mode (M1) described in the first embodiment, and the throttle valve (2) is controlled with low with suppressing increase of the load of the microcomputer (11A).

If the load status signal (DL) of the processing load judging means (23) is the light load signal (DLL), the switching means (45) selects the first connection state, and the superposition signal (SS) from the synthesizer (47) is supplied as an analog input voltage of the AD converting means (30).

FIGS. 9(*a*) and 9(*b*) show the superposition signal (SS) varying between the voltage value V1 to the analog input voltage V and the voltage (V1+a) achieved by adding the voltage value V1 and the resolution a of the AD converting means (30). In FIG. 9(*a*) shows the superposition signal (SS) under a state that the analog opening degree detection signal (AS) between the voltage values V1 and (V1+a) is small in level, and 9(*b*) shows the superposition signal SS under a state that the analog opening degree detection signal (AS) varying between the voltage values V1 and (V1+a) is larger in level.

When the superposition signal (SS) varies from FIG. 9(*a*) to FIG. 9(*b*), an area of the superposition signal (SS) which exceeds the voltage (V1+a) is increased in level, and thus the period for which the digital conversion output is increased by one step is increased. Therefore, the digital conversion output increases on average even between the voltage values V1 and (V1+a), so that the precision of the digital conversion output is enhanced under a state that the switching means (45) outputs the superposition signal (SS).

As described above, according to the second embodiment, when the load status signal (DL) is a light load signal (DLL), the AD converting means (30) carries out digital conversion of high precision, and the throttle valve (2) can be controlled with higher precision as in the case of the first embodiment.

The invention is applicable as a throttle control device for an engine mounted in a vehicle or the like.

What is claimed is:

1. An electronic throttle control device for an engine, comprising:

a throttle valve for adjusting a suction air amount of the engine;

a throttle opening degree detecting unit for detecting an opening degree of the throttle valve and generating an analog opening degree detection signal whose magnitude corresponds to the opening degree of the throttle valve; and a throttle valve control block for controlling the opening degree of the throttle valve, the throttle valve control block is constructed by commonly using a microcomputer for carrying out other control operation for the engine, wherein the throttle valve control block includes a processing load judging means for judging a processing load status of the microcomputer, an AD converting means for converting the analog opening degree detection signal and outputting a digital opening degree detection signal at an output point, and a throttle valve control means for controlling the opening degree of the throttle valve on the basis of a digital opening degree target signal to the throttle valve and the digital opening degree detection signal, and the AD converting means has a first conversion mode in which the analog opening degree detection signal is converted to the digital opening degree detection signal with high conversion precision, and a second conversion mode in which the analog opening degree detection signal is converted to the digital opening degree detection signal with low conversion precision lower than the first conversion mode, and the first and second conversion modes are switched by the processing load judging means.

2. The electronic throttle control device for the engine according to claim 1, wherein the microcomputer carries out at least one of a fuel injection control operation for the engine and an ignition control operation for the engine as the other control operation for the engine.

3. The electronic throttle control device for the engine according to claim 1, wherein when the processing load judging means judges that a processing load status of the microcomputer is a heavy load, the AD converting means is switched to the second conversion mode, and when the processing load judging means judges that the processing load status of the microcomputer is a light load, the AD converting means is switched to the first conversion mode.

4. The electronic throttle control device for the engine according to claim 3, wherein the processing load judging means is supplied with a rotation signal representing a rotational number of the engine, and judges that the processing load status of the microcomputer is the heavy load when the rotational number of the engine is high and judges that the processing load status of the microcomputer is the light load when the rotational number of the engine is low.

5. The electronic throttle control device for the engine according to claim 4, wherein the processing load judging means judges that the processing load status of the microcomputer is the heavy load when the rotational number of the engine is higher than a predetermined value, and judges that the processing load status of the microcomputer is the light load when the rotational number of the engine is smaller than a predetermined value.

6. The electronic throttle control device for the engine according to claim 1, wherein the AD converting means outputs plural digital outputs of numbers N on the basis of the analog opening degree detection signal in the first conversion mode, and outputs digital outputs of numbers M (M<N) on the basis of the analog opening degree detection signal in the second conversion mode.

7. The electronic throttle control device for the engine according to claim 6, wherein a level converting circuit for generating analog signals of numbers N different in level on the basis of the analog opening degree detection signal is connected to an analog input portion of the AD converting means.

8. The electronic throttle control device for the engine according to claim 7, wherein the AD converting means converts each of the analog signals of numbers N to a digital output in the first conversion mode, and outputs a digital addition signal achieved by adding the digital outputs of numbers N as the digital opening degree detection signal to the output point.

9. The electronic throttle control device for the engine according to claim 7, wherein the AD converting means converts one analog signal based on the analog opening degree detection signal to a digital output in the second conversion mode, and outputting the digital output as the digital opening degree detection signal to the output point.

10. The electronic throttle control device for the engine according to claim 6, wherein a switching means is connected to a digital output portion of the AD converting means, and the switching means switches the digital opening degree detection signal having high conversion precision based on the first conversion mode and the digital opening degree detection signal having low conversion precision based on the second conversion mode by the processing load judging means.

11. The electronic throttle control device for the engine according to claim 1, wherein the AD converting means digitally converts the analog opening degree detection signal in the second conversion mode, and digitally converts a superposition signal achieved by superposing the analog opening degree detection signal with aperiodic variation signal having a frequency higher than the analog opening degree detection signal in the first conversion mode.

12. The electronic throttle control device for the engine according to claim 11, wherein a switching means for switching the analog opening degree detection signal and the superposition signal is connected to an analog input portion of the AD converting means.

13. The electronic throttle control device for the engine according to claim 12, wherein the switching means is switched by the processing load judging means.

* * * * *